US010767906B2

(12) United States Patent
Zha et al.

(10) Patent No.: US 10,767,906 B2
(45) Date of Patent: Sep. 8, 2020

(54) HOT GAS DEFROST IN A COOLING SYSTEM

(71) Applicant: Heatcraft Refrigeration Products LLC, Stone Mountain, GA (US)

(72) Inventors: Shitong Zha, Snellville, GA (US); Xi Sun, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 198 days.

(21) Appl. No.: 15/448,278

(22) Filed: Mar. 2, 2017

(65) Prior Publication Data

US 2018/0252441 A1 Sep. 6, 2018

(51) Int. Cl.
*F25B 5/02* (2006.01)
*F25B 47/02* (2006.01)
(Continued)

(52) U.S. Cl.
CPC ..... *F25B 5/02* (2013.01); *F25B 1/10* (2013.01); *F25B 31/002* (2013.01);
(Continued)

(58) Field of Classification Search
CPC ..... F25B 5/00; F25B 5/02; F25B 1/10; F25B 47/02; F25B 47/022; F25B 31/002;
(Continued)

(56) References Cited

U.S. PATENT DOCUMENTS 3,150,498 A * 9/1964 Blake ..... F25B 1/10 62/113
4,122,686 A * 10/1978 Lindahl ..... F25B 5/02 62/196.1
(Continued)

FOREIGN PATENT DOCUMENTS

EP 1050726 11/2000
EP 1050726 A2 11/2000
(Continued)

OTHER PUBLICATIONS

European Patent Office, Extended European Search Report, Application No. 18158683.5, dated Aug. 13, 2018, 6 pages.
(Continued)

*Primary Examiner* — Jianying C Atkisson
*Assistant Examiner* — Miguel A Diaz
(74) *Attorney, Agent, or Firm* — Baker Botts L.L.P.

(57) ABSTRACT

A system includes a high side heat exchanger, a first load, a second load, a first compressor, a second compressor, and a third compressor. The high side heat exchanger removes heat from a refrigerant. The first load uses the refrigerant to remove heat from a first space proximate the first load. The second load uses the refrigerant to remove heat from a second space proximate the second load. The first compressor compresses the refrigerant from the first load and sends the refrigerant to the first load. The refrigerant defrosts the first load. The second compressor compresses the refrigerant from the second load and the refrigerant from the first load that defrosted the first load. The third compressor compresses the refrigerant from the first compressor.

22 Claims, 3 Drawing Sheets

(51) Int. Cl.
*F25B 31/00* (2006.01)
*F25B 1/10* (2006.01)
*F25B 43/02* (2006.01)
*F25B 43/00* (2006.01)

(52) U.S. Cl.
CPC ..... *F25B 43/006* (2013.01); *F25B 47/022* (2013.01); *F25B 2400/075* (2013.01); *F25B 2400/13* (2013.01); *F25B 2400/23* (2013.01)

(58) Field of Classification Search
CPC ..... F25B 43/006; F25B 2400/13; F25B 2400/23; F25B 2400/075; F25B 5/04; F25B 2347/02; F25B 2347/021
See application file for complete search history.

(56) References Cited

U.S. PATENT DOCUMENTS 4,621,505 A * 11/1986 Ares ..... F25B 5/02 62/196.4
7,171,817 B2 * 2/2007 Birgen ..... F25B 13/00 62/140
7,610,766 B2 * 11/2009 Dube ..... F25B 5/02 62/151
9,377,236 B2 * 6/2016 Hinde ..... F25B 1/10
2005/0138936 A1 * 6/2005 Dub ..... F25B 5/02 62/81
2006/0272345 A1 * 12/2006 Ueno ..... F25B 13/00 62/278
2007/0074523 A1 * 4/2007 Takegami ..... F25B 13/00 62/151
2008/0110200 A1 * 5/2008 Javerschek ..... F25B 9/008 62/515
2009/0031737 A1 * 2/2009 Ueno ..... F25B 13/00 62/151
2009/0126399 A1 * 5/2009 Takegami ..... F25B 13/00 62/510
2012/0011866 A1 * 1/2012 Scarcella ..... F25B 1/10 62/79
2013/0319036 A1 * 12/2013 Taras ..... F25B 9/008 62/434
2014/0053585 A1 * 2/2014 Huff ..... F25B 1/10 62/115
2014/0151015 A1 * 6/2014 Sun ..... F25B 49/02 165/253
2014/0352343 A1 * 12/2014 Hinde ..... F25B 1/10 62/277
2015/0345835 A1 * 12/2015 Martin ..... F25B 7/00 62/238.3
2016/0258662 A1 * 9/2016 Zimmermann ..... F25B 49/022
2017/0159977 A1 * 6/2017 Hellmann ..... F25B 1/10
2017/0167762 A1 * 6/2017 Kato ..... F24F 11/89
2018/0187926 A1 * 7/2018 Najafifard ..... F25B 9/008
2018/0216851 A1 * 8/2018 Christensen ..... F25B 1/10
2018/0245822 A1 * 8/2018 Punuru ..... F25B 5/02
2018/0252441 A1 * 9/2018 Zha ..... F25B 5/02
2018/0274823 A1 * 9/2018 Rajendiran ..... F25B 1/10
2020/0064037 A1 * 2/2020 Ferretti ..... F25B 49/02

FOREIGN PATENT DOCUMENTS

EP 1050726 A3 8/2002
WO 2009052369 A2 4/2009
WO WO2009/052369 4/2009
WO 2011054397 A1 5/2011
WO WO2011/054397 5/2011
WO WO-2013031591 A1 * 3/2013 ..... F25B 1/10

OTHER PUBLICATIONS

Communication for Application No. 18158683.5-1008, 6 pages; dated Aug. 13, 2018.

* cited by examiner

HOT GAS DEFROST IN A COOLING SYSTEM

TECHNICAL FIELD

This disclosure relates generally to a cooling system, specifically hot gas defrost in a cooling system.

BACKGROUND

Cooling systems may cycle a refrigerant to cool various spaces. For example, a refrigeration system may cycle refrigerant to cool spaces near or around refrigeration loads. After the refrigerant absorbs heat, it can be cycled back to the refrigeration loads to defrost the refrigeration loads.

SUMMARY OF THE DISCLOSURE

According to one embodiment, a system includes a high side heat exchanger, a first load, a second load, a first compressor, a second compressor, and a third compressor. The high side heat exchanger removes heat from a refrigerant. The first load uses the refrigerant to remove heat from a first space proximate the first load. The second load uses the refrigerant to remove heat from a second space proximate the second load. The first compressor compresses the refrigerant from the first load and sends the refrigerant to the first load. The refrigerant defrosts the first load. The second compressor compresses the refrigerant from the second load and the refrigerant from the first load that defrosted the first load. The third compressor compresses the refrigerant from the first compressor.

According to another embodiment, a method includes removing heat from a refrigerant using a high side heat exchanger and removing heat from a first space proximate a first load using the refrigerant. The method also includes removing heat from a second space proximate a second load using the refrigerant and compressing the refrigerant from the first load using a first compressor. The method further includes sending the refrigerant compressed at the first compressor to the first load. The refrigerant defrosts the first load and compressing the refrigerant from the second load using a second compressor. The method also includes compressing the refrigerant from the first load that defrosted the first load using the second compressor and compressing the refrigerant from the first compressor using the third compressor.

According to yet another embodiment, a system includes a first load, a second load, a first compressor, a second compressor, and a third compressor. The first load uses a refrigerant to remove heat from a first space proximate the first load. The second load uses the refrigerant to remove heat from a second space proximate the second load. The first compressor compresses the refrigerant from the first load and sends the refrigerant to the first load. The refrigerant defrosts the first load. The second compressor compresses the refrigerant from the second load and the refrigerant from the first load that defrosted the first load. The third compressor compresses the refrigerant from the first compressor.

Certain embodiments may provide one or more technical advantages. For example, an embodiment reduces the size of the piping used in existing cooling systems. As another example, an embodiment removes a stepper valve used in existing cooling systems. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
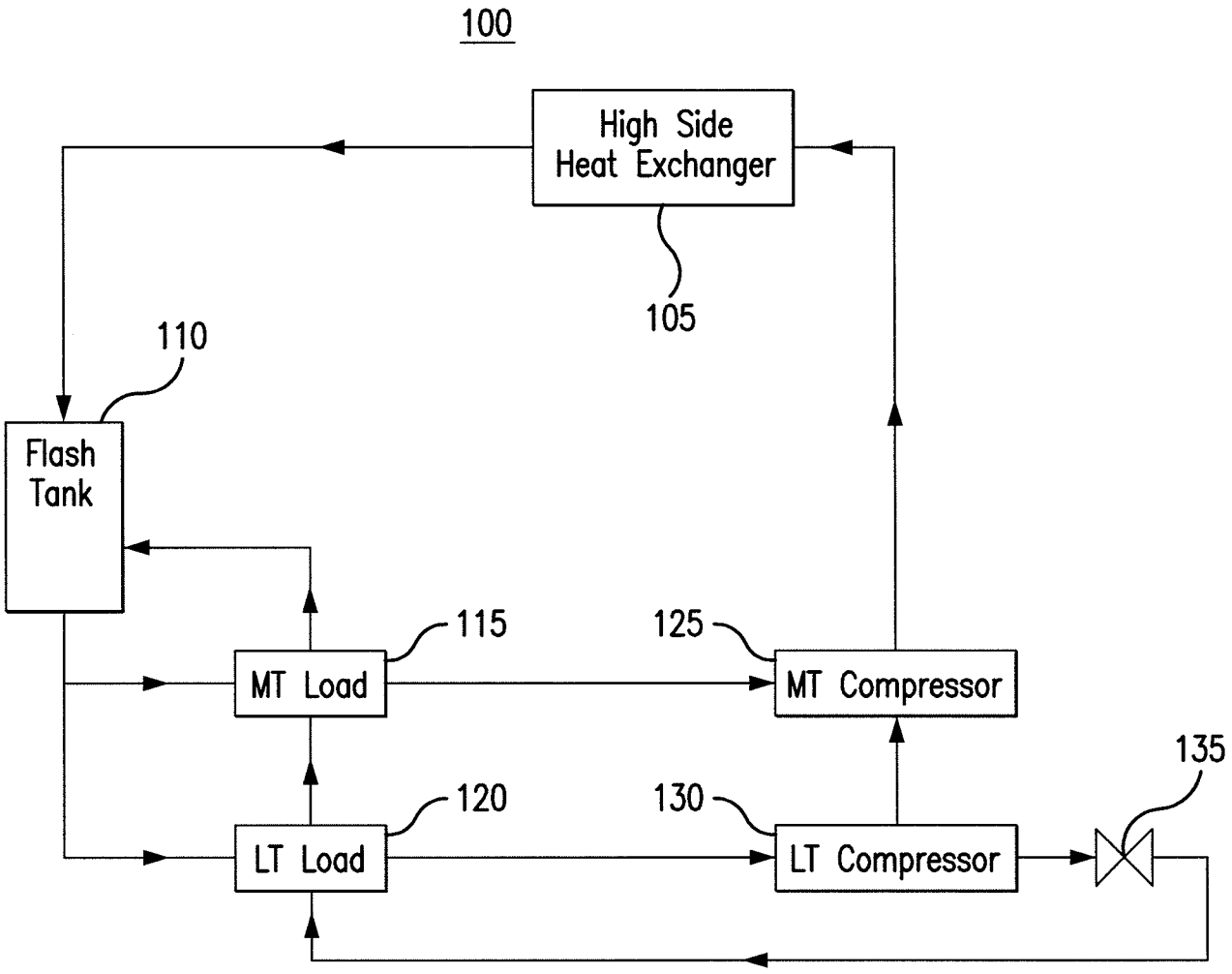
FIG. 1 illustrates an example cooling system.
Figure 2:
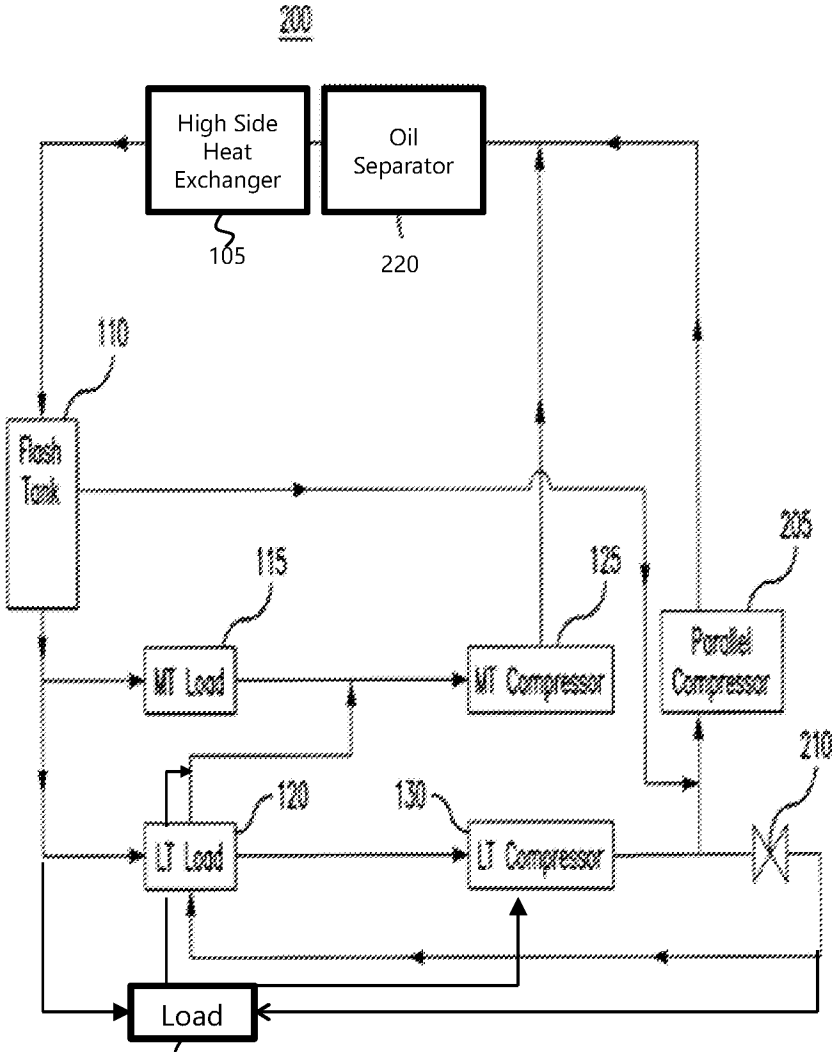
FIG. 2 illustrates an example cooling system.
Figure 3:
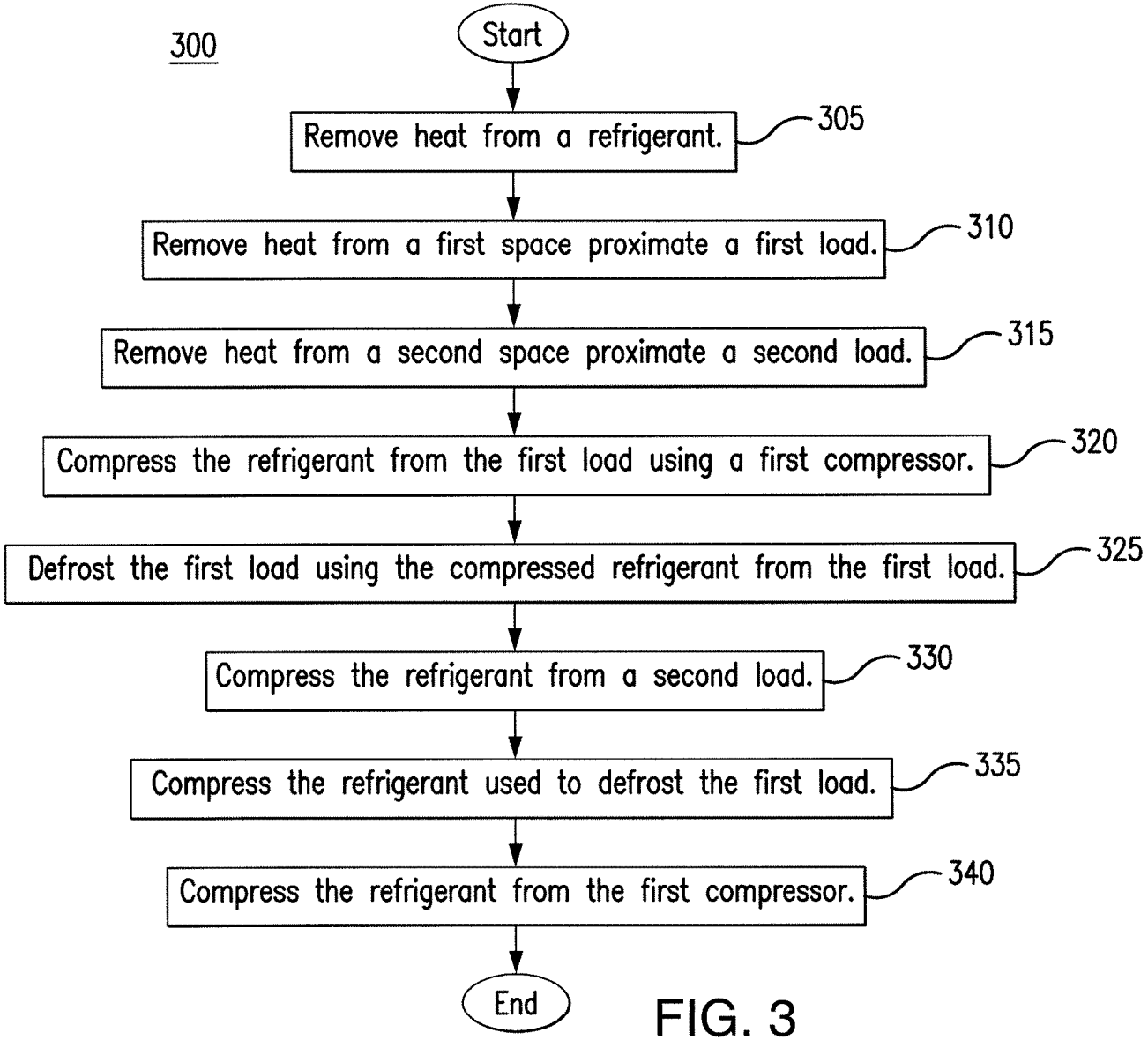
FIG. 3 is a flowchart illustrating a method of operating the example cooling system of FIG. 2.

Embodiments of the present disclosure and its advantages are best understood by referring to FIGS. 1 through 3 of the drawings, like numerals being used for like and corresponding parts of the various drawings.

Cooling systems may cycle refrigerant to cool various spaces. For example, a refrigeration system may cycle refrigerant to cool spaces near or around refrigeration loads. These loads may include metal components, such as coils, that carry the refrigerant. As the refrigerant passes through these metallic components, frost and/or ice may accumulate on the exterior of these metallic components. The ice and/or frost may reduce the efficiency of the load. For example, as frost and/or ice accumulates on a load, it may become more difficult for the refrigerant within the load to absorb heat that is external to the load.

In existing systems, one way to address frost and/or ice accumulation on the load is to cycle the refrigerant to the load after the refrigerant has absorbed heat from the load. In this manner, the heated refrigerant may pass over the frost and/or ice accumulation and defrost the load. This process of cycling hot refrigerant over frosted and/or iced loads is known as hot gas defrost.

Existing cooling systems that have a hot gas defrost cycle require a stepper valve to build up discharge pressure for hot gas defrost. For example, the stepper valve may increase the pressure of the refrigerant from 28 bar to 40 bar. After the hot gas is used to defrost the load, the gas is pumped to a flash tank that usually stores refrigerant at 36 bar. The small pressure difference between the hot gas supply and the flash tank (for example, 40 bar−36 bar=4 bar) results in the need for large piping to limit the pressure drop across the hot gas/refrigerant line. If the pressure drop across the hot gas/refrigerant is too large, then the pressure at the flash tank may overtake the pressure at the stepper valve and the flow of the hot gas may reverse and/or stop. The large piping increases the material cost of the refrigeration system and it increases the amount of space occupied by the refrigeration system.

This disclosure contemplates a cooling system that removes the need for a stepper valve. The cooling system includes a parallel compressor that receives refrigerant from a low temperature compressor. The refrigerant from the low temperature compressor is also cycled back to a low temperature load to defrost the low temperature load. After defrosting, the refrigerant is then cycled to a medium temperature compressor. In this manner, the pressure difference between the hot gas supply and the hot gas return is increased. The increased pressure difference may allow piping of reduced sizing to be used in the cooling system. Reducing the size of the piping may reduce the cost of the system and the space needed to install the system. In some embodiments, reducing the size of the piping may also allow a reduction in the refrigerant charge and the size of a flash tank used in the system.

The cooling system will be described using FIGS. 1 through 3. FIG. 1 will describe an existing cooling system with hot gas defrost. FIGS. 2 and 3 describe the cooling system with improved hot gas defrost.

FIG. 1 illustrates an example cooling system 100. As shown in FIG. 1, system 100 includes a high side heat exchanger 105, a flash tank 110, a medium temperature load 115, a low temperature load 120, a medium temperature compressor 125, a low temperature compressor 130, and a valve 135. By operating valve 135, system 100 allows for hot gas to be circulated to low temperature load 120 to defrost low temperature load 120. After defrosting low temperature load 120, the hot gas and/or refrigerant is cycled back to flash tank 110.

High side heat exchanger 105 may remove heat from a refrigerant. When heat is removed from the refrigerant, the refrigerant is cooled. This disclosure contemplates high side heat exchanger 105 being operated as a condenser, a fluid cooler, and/or a gas cooler. When operating as a condenser, high side heat exchanger 105 cools the refrigerant such that the state of the refrigerant changes from a gas to a liquid. When operating as a fluid cooler, high side heat exchanger 105 cools liquid refrigerant and the refrigerant remains a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 may store refrigerant received from high side heat exchanger 105. This disclosure contemplates flash tank 110 storing refrigerant in any state such as, for example, a liquid state and/or a gaseous state. Refrigerant leaving flash tank 110 is fed to low temperature load 120 and medium temperature load 115. In some embodiments, a flash gas and/or a gaseous refrigerant is released from flash tank 110. By releasing flash gas, the pressure within flash tank 110 may be reduced.

System 100 may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant may flow from flash tank 110 to both the low temperature and medium temperature portions of the refrigeration system. For example, the refrigerant may flow to low temperature load 120 and medium temperature load 115. When the refrigerant reaches low temperature load 120 or medium temperature load 115, the refrigerant removes heat from the air around low temperature load 120 or medium temperature load 115. As a result, the air is cooled. The cooled air may then be circulated such as, for example, by a fan to cool a space such as, for example, a freezer and/or a refrigerated shelf. As refrigerant passes through low temperature load 120 and medium temperature load 115 the refrigerant may change from a liquid state to a gaseous state as it absorbs heat.

The refrigerant may cool metallic components of low temperature load 120 and medium temperature load 115 as the refrigerant passes through low temperature load 120 and medium temperature load 115. For example, metallic coils, plates, parts of low temperature load 120 and medium temperature load 115 may cool as the refrigerant passes through them. These components may become so cold that vapor in the air external to these components condenses and eventually freeze or frost onto these components. As the ice or frost accumulates on these metallic components, it may become more difficult for the refrigerant in these components to absorb heat from the air external to these components. In essence, the frost and ice acts as a thermal barrier. As a result, the efficiency of cooling system 100 decreases the more ice and frost that accumulates. Cooling system 100 may use heated refrigerant to defrost these metallic components.

Refrigerant may flow from low temperature load 120 and medium temperature load 115 to compressors 125 and 130. This disclosure contemplates system 100 including any number of low temperature compressors 130 and medium temperature compressors 125. Both the low temperature compressor 130 and medium temperature compressor 125 may be configured to increase the pressure of the refrigerant. As a result, the heat in the refrigerant may become concentrated and the refrigerant may become a high pressure gas. Low temperature compressor 130 may compress refrigerant from low temperature load 120 and send the compressed refrigerant to medium temperature compressor 125. Medium temperature compressor 125 may compress refrigerant from low temperature compressor 130 and medium temperature load 115. Medium temperature compressor 125 may then send the compressed refrigerant to high side heat exchanger 105.

Valve 135 may be opened or closed to cycle refrigerant from low temperature compressor 130 back to low temperature load 120. The refrigerant may be heated after absorbing heat from low temperature load 120 and being compressed by low temperature compressor 130. The hot refrigerant and/or hot gas is then cycled over the metallic components of low temperature load 120 to defrost those components. Afterwards, the hot gas and/or refrigerant is cycled back to flash tank 110.

Valve 135 includes a stepper valve that increases the pressure of the hot gas and/or refrigerant so that it can be cycled back to low temperature load 120 to defrost low temperature load 120. For example, the stepper valve may increase the pressure of the hot gas and/or refrigerant from 28 bar to 40 bar. The stepper valve is needed so that the pressure of the hot gas and/or refrigerant can be increased above the pressure of flash tank 110 (the pressure of flash tank 110 may be 36 bar, for example). In this manner, the hot gas and/or refrigerant may be at a high enough pressure to be cycled back into flash tank 110.

In this example, the pressure difference between the hot gas and/or refrigerant and flash tank 110 may be around 4 bar because the stepper valve increases the pressure of the refrigerant to 40 bar and flash tank 110 is held at 36 bar. This difference in pressure of 4 bar is small and results in system 100 needing large piping to limit the pressure drop of the hot gas and/or refrigerant as it defrosts low temperature load 120 and then travels to flash tank 110. If the pressure drop across the hot gas and/or refrigerant line is too large, then the pressure at flash tank 110 may overcome the pressure at the stepper valve and the flow of hot gas and/or refrigerant may reverse and/or stop The large piping results in increased cost and a larger footprint for system 100.

FIG. 2 illustrates an example cooling system 200. As shown in FIG. 2, system 200 includes a high side heat exchanger 105, a flash tank 110, a medium temperature load 115, a low temperature load 120, a medium temperature compressor 125, a low temperature compressor 130, a parallel compressor 205, and a valve 210. System 200 includes several components that are also present in system 100. These components may operate similarly as they do in system 100. However, system 200 differs from system 100 in that system 200 includes a different configuration that allows for a reduction in the size of the piping used to carry the hot gas that defrosts low temperature load 120.

Parallel compressor 205 may be a compressor that compresses refrigerant from low temperature compressor 130 and flash gas from flash tank 110. Parallel compressor 205 sends the compressed refrigerant and/or flash gas to high side heat exchanger 105. Unlike system 100, low temperature compressor 130 in system 200 does not send compressed refrigerant directly to medium temperature compressor 125.

Valve 210 may be open and/or closed to allow hot gas and/or refrigerant to be cycled back to low temperature load 120 to defrost low temperature load 120. After defrosting low temperature load 120, the hot gas and/or refrigerant may be cycled to medium temperature compressor 125 instead of flash tank 110. In certain embodiments, the configuration of system 200 may result in a larger pressure differential between the hot gas supply and the hot gas return. Using the numbers from the previous example, the hot gas supply, for example the hot gas coming from low temperature compressor 130, may be at the pressure of flash tank 110 which is 36 bar. The pressure at medium temperature compressor 125 may be 28 bar resulting in a pressure difference of 8 bar, which is larger than the pressure difference in system 100 of 4 bar. As a result of the larger pressure difference, the size of the piping used to transport the hot gas and/or refrigerant may be reduced. The reduced size decreases the cost of system 200 and it reduces the footprint of system 200. In some embodiments, the larger pressure difference also means that valve 210 does not need to include a stepper valve.

In certain embodiments, system 200 may include additional low temperature loads 120. For example, system 200 may include a second low temperature load 215 that receives refrigerant from flash tank 110. The second low temperature load 215 may send refrigerant to low temperature compressor 130 and/or a second low temperature compressor 130. The compressed refrigerant may then be sent to parallel compressor 205 and/or may be cycled back to low temperature load 120 and/or the second low temperature load 215 to defrost those loads.

In certain embodiments, system 200 may include a heat exchanger that transfers heat between refrigerant from high side heat exchanger 105 and refrigerant from medium temperature load 115. The heat exchanger may also transfer heat between refrigerant from high side heat exchanger 105 and refrigerant that is used to defrost low temperature load 120. In this manner, the heat of the refrigerant arriving at medium temperature compressor 125 may be regulated.

In particular embodiments, system 200 includes an oil separator 220 before high side heat exchanger 105. The oil separator 220 may separate oils from the refrigerant from medium temperature compressor 125 and parallel compressor 205. By separating the oil from the refrigerant, it may be easier for high side heat exchanger 105 to remove heat from the refrigerant. Additionally, separating oil from the refrigerant may increase the lifetime and/or efficiency of other components of system 200. The oil separator 220 may separate the oil from the refrigerant and send the refrigerant to high side heat exchanger 105.

This disclosure contemplates system 200 including any number of components. For example, system 200 may include any number of low temperature loads, medium temperature loads, and air conditioning loads. As another example, system 200 may include any number of low temperature compressors, medium temperature compressors, and parallel compressors. As yet another example, system 200 may include any number of high side heat exchangers 105 and flash tanks 110. This disclosure also contemplates cooling system 200 using any appropriate refrigerant. For example, cooling system 200 may use a carbon dioxide refrigerant. This disclosure also contemplates system 200 being configured for hot gas defrost on any of medium temperature load(s) 115 and low temperature load(s) 120. After the hot gas is used to defrost a load, the hot gas may be sent to medium temperature compressor 125. System 200 may include multiple valves 210 that direct the hot gas to any of medium temperature load(s) 115 and low temperature load(s) 120.

FIG. 3 is a flowchart illustrating a method 300 of operating the example cooling system 200 of FIG. 2. Various components of system 200 perform the steps of method 300. In particular embodiments, performing method 300 may allow for the size of the piping used to transport hot gas and/or refrigerant to be reduced thereby leading to a reduction in cost and a reduction in footprint of system 200.

High side heat exchanger 105 removes heat from a refrigerant in step 305. In step 310, low temperature load 120 removes heat from a first space proximate low temperature load 120. In step 315, medium temperature load 115 removes heat from a second space proximate medium temperature load 115. Low temperature compressor 130 compresses the refrigerant from low temperature load 120 in step 320. In step 325, the compressed refrigerant from low temperature compressor 130 is used to defrost low temperature load 120. Medium temperature compressor 125 compresses the refrigerant from medium temperature load 115 in step 330. In step 335, medium temperature compressor 125 compresses the refrigerant used to defrost low temperature load 120. In step 340, parallel compressor 205 compresses the refrigerant from low temperature compressor 130.

Modifications, additions, or omissions may be made to method 300 depicted in FIG. 3. Method 300 may include more, fewer, or other steps. For example, steps may be performed in parallel or in any suitable order. While discussed as various components of cooling system 200 performing the steps, any suitable component or combination of components of system 200 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A method comprising:

removing heat from a refrigerant using a high side heat exchanger;

storing the refrigerant from the high side heat exchanger using a flash tank;

during a first mode of operation:

removing heat from a first space proximate a first load using the refrigerant removing heat from a second space proximate a second load using the refrigerant;

compressing the refrigerant from the first load using a first compressor;

compressing the refrigerant from the second load using a second compressor before the refrigerant from the second load reaches the flash tank;

compressing the refrigerant from the first compressor using a third compressor before the refrigerant reaches the high side heat exchanger;

during a second mode of operation:

removing heat from the second space proximate the second load using the refrigerant;

compressing the refrigerant from the first load using the first compressor;

compressing the refrigerant from the second load using the second compressor before the refrigerant from the second load reaches the flash tank;

sending the refrigerant compressed at the first compressor to the first load, wherein the refrigerant defrosts the first load; and compressing the refrigerant from the first load that defrosted the first load using the second compressor before the refrigerant from the first load that defrosted the first load reaches the flash tank.

2. The method of claim 1, further comprising:

during the first mode of operation, removing heat from a third space proximate a third load using the refrigerant;

compressing the refrigerant from the third load using the first compressor; and during the second mode of operation, sending the refrigerant to the third load, wherein the refrigerant defrosts the third load.

3. The method of claim 1, wherein the second space is at a higher temperature than the first space.

4. The method of claim 1, further comprising:

receiving the refrigerant from the second compressor and the third compressor at an oil separator; and sending the refrigerant to the high side heat exchanger.

5. The method of claim 1, further comprising:

discharging a flash gas from the flash tank; and compressing the flash gas using the third compressor.

6. The method of claim 1, further comprising transferring heat between the refrigerant from the high side heat exchanger and the refrigerant from the second load using a heat exchanger.

7. The method of claim 6, further comprising, during the second mode of operation, transferring heat between the refrigerant from the high side heat exchanger and the refrigerant from the first load that defrosted the first load using the heat exchanger.

8. A system comprising:

a flash tank configured to store a refrigerant;

a first load;

a second load configured to use the refrigerant to remove heat from a second space proximate the second load;

a first compressor configured to compress the refrigerant from the first load;

a second compressor; and a third compressor, during a first mode of operation:

the first load is configured to use the refrigerant to remove heat from a first space proximate the first load;

the second compressor is configured to compress the refrigerant from the second load before the refrigerant from the second load reaches the flash tank; and the third compressor is configured to compress the refrigerant from the first compressor before the refrigerant reaches the high side heat exchanger; and during a second mode of operation:

the first compressor is configured to send the refrigerant to the first load, wherein the refrigerant defrosts the first load; and the second compressor is configured to:

compress the refrigerant from the second load before the refrigerant from the second load reaches the flash tank; and compress the refrigerant from the first load that defrosted the first load before the refrigerant from the first load that defrosted the first load reaches the flash tank.

9. The system of claim 8, further comprising a third load, the first compressor further configured to compress the refrigerant from the third load, wherein, during the first mode of operation, the third load is configured to use the refrigerant to remove heat from a third space proximate the third load, wherein, during the second mode of operation, the first compressor is further configured to send the refrigerant to the third load, wherein the refrigerant defrosts the third load.

10. The system of claim 8, wherein the second space is at a higher temperature than the first space.

11. The system of claim 8, further comprising an oil separator configured to:

receive the refrigerant from the second compressor and the third compressor; and send the refrigerant to a high side heat exchanger.

12. The system of claim 8, wherein the flash tank is further configured to discharge a flash gas, wherein the third compressor is further configured to compress the flash gas.

13. The system of claim 8, further comprising a heat exchanger configured to transfer heat between the refrigerant from a high side heat exchanger and the refrigerant from the second load.

14. The system of claim 13, wherein, during the second mode of operation, the heat exchanger is further configured to transfer heat between the refrigerant from the high side heat exchanger and the refrigerant from the first load that defrosted the first load.

15. A system comprising:

a high side heat exchanger configured to remove heat from a refrigerant;

a flash tank configured to store the refrigerant from the high side heat exchanger;

a first load;

a second load configured to use the refrigerant to remove heat from a second space proximate the second load;

a first compressor configured to compress the refrigerant from the first load;

a second compressor; and a third compressor, during a first mode of operation:

the first load is configured to use the refrigerant to remove heat from a first space proximate the first load;

the second compressor is configured to compress the refrigerant from the second load before the refrigerant from the second load reaches the flash tank; and the third compressor is configured to compress the refrigerant from the first compressor before the refrigerant reaches the high side heat exchanger, and during a second mode of operation:

the first compressor is configured to send the refrigerant to the first load, wherein the refrigerant defrosts the first load; and the second compressor is configured to:

compress the refrigerant from the second load before the refrigerant from the second load reaches the flash tank; and compress the refrigerant from the first load that defrosted the first load before the refrigerant from the first load that defrosted the first load reaches the flash tank.

16. The system of claim 15, further comprising a third load, the first compressor further configured to compress the refrigerant from the third load, wherein, during the first mode of operation, the third load is configured to use the refrigerant to remove heat from a third space proximate the third load, wherein, during the second mode of operation, the first compressor is further configured to send the refrigerant to the third load, wherein the refrigerant defrosts the third load.

17. The system of claim 15, wherein the second space is at a higher temperature than the first space.

18. The system of claim 15, further comprising an oil separator configured to:

receive the refrigerant from the second compressor and the third compressor; and send the refrigerant to the high side heat exchanger.

19. The system of claim 15, wherein the flash tank is configured to discharge a flash gas and the third compressor is further configured to compress the flash gas.

20. The system of claim 15, wherein, during the second mode of operation, the second compressor is further configured to compress the refrigerant from the first load that defrosted the first load before the refrigerant from the first load that defrosted the first load reaches the second load.

21. The system of claim 15, further comprising a heat exchanger configured to transfer heat between the refrigerant from the high side heat exchanger and the refrigerant from the second load.

22. The system of claim 21, wherein, during the second mode of operation, the heat exchanger is further configured to transfer heat between the refrigerant from the high side heat exchanger and the refrigerant from the first load that defrosted the first load.

* * * * *